US010851564B2

(12) United States Patent
Gulick, Jr. et al.

(10) Patent No.: US 10,851,564 B2
(45) Date of Patent: Dec. 1, 2020

(54) GOLF CLUB SECURITY DEVICE

(71) Applicant: Scorpion Security Products, Inc., Vestal, NY (US)

(72) Inventors: Franklyn W. Gulick, Jr., Binghamton, NY (US); Grant William Gulick, Chenango Forks, NY (US); Gary Robert Page, Chenango Forks, NY (US)

(73) Assignee: Scorpion Security Products, Inc., Vestal, NY (US)

( * ) Notice: Subject to any disclaimer, the term of this patent is extended or adjusted under 35 U.S.C. 154(b) by 210 days.

(21) Appl. No.: 16/141,033

(22) Filed: Sep. 25, 2018

(65) Prior Publication Data

US 2019/0093394 A1 Mar. 28, 2019

Related U.S. Application Data

(60) Provisional application No. 62/562,697, filed on Sep. 25, 2017.

(51) Int. Cl.

| | |
|---|---|
| ***E05B 73/00*** | (2006.01) |
| ***A63B 53/00*** | (2015.01) |
| *A63B 55/00* | (2015.01) |

(52) U.S. Cl.

CPC ..... *E05B 73/0041* (2013.01); *A63B 53/00* (2013.01); *A63B 2055/403* (2015.10)

(58) Field of Classification Search

CPC ..... E05B 73/0041; A63B 53/00; A63B 2055/403

USPC ..... 70/14, 57, 57.1, 58, 208, 201–203, 181, 70/209; 340/568.6, 572.9

See application file for complete search history.

(56) References Cited

U.S. PATENT DOCUMENTS

| | | | | | |
|---|---|---|---|---|---|
| 2,330,536 | A * | 9/1943 | Zimmermann | B60R 25/005 | 70/199 |
| 4,317,477 | A * | 3/1982 | Baptista | A63B 55/10 | 206/315.2 |
| 5,267,458 | A * | 12/1993 | Heh | B60R 25/0221 | 70/199 |
| 5,400,627 | A * | 3/1995 | Liao | B60R 25/0225 | 70/209 |
| 5,676,000 | A * | 10/1997 | Chen | B60R 25/0225 | 307/10.2 |
| 6,057,762 | A * | 5/2000 | Dusza | A63B 55/00 | 340/568.6 |

(Continued)

*Primary Examiner* — Suzanne L Barrett
(74) *Attorney, Agent, or Firm* — Barclay Damon LLP

(57) ABSTRACT

A security device comprises a body having, a lock portion and a securing member. The lock portion may comprise a first engagement member, a second engagement member. The securing member comprises a first interface portion having a locking member, a second interface portion, and a hinge member configured to pivotally couple the first interface portion to the second interface portion. The security device further comprises an extension having a first end and a second end and comprising a head engagement section proximate the first end, and a locking member engagement portion proximate the second end. In an assembled state, the extension is configured to be coupled to the locking member engagement portion and configured to engage the first engagement member, and the second engagement member is configured to engage the locking member.

14 Claims, 12 Drawing Sheets

(56) References Cited

U.S. PATENT DOCUMENTS

| | | | | |
|---|---|---|---|---|
| 6,326,890 | B1 * | 12/2001 | Costa | B65D 63/1072 340/568.1 |
| 6,662,894 | B2 * | 12/2003 | Chantrasuwan | B60R 25/005 180/287 |
| 7,134,302 | B2 * | 11/2006 | Gorst | E05B 73/0041 70/57.1 |
| 8,269,631 | B2 * | 9/2012 | Yang | G08B 13/1463 340/426.1 |
| 8,482,414 | B2 * | 7/2013 | Leyden | E05B 73/0017 340/568.1 |
| 8,733,138 | B2 * | 5/2014 | Favier | E05B 73/0017 70/19 |
| D709,399 | S * | 7/2014 | Strauser | D10/106.92 |
| 9,254,426 | B2 * | 2/2016 | Sandoval | G08B 13/1436 |
| 9,472,073 | B2 * | 10/2016 | Yang | E05B 73/0041 |
| 9,909,341 | B2 * | 3/2018 | Thoonsen | E05B 73/0035 |
| 2001/0005997 | A1 * | 7/2001 | Vito | B60R 25/0221 70/202 |
| 2003/0008722 | A1 * | 1/2003 | Konow | A63B 60/00 473/223 |
| 2003/0074934 | A1 * | 4/2003 | Moreton | B60R 25/0225 70/209 |
| 2006/0021394 | A1 * | 2/2006 | Belden, Jr. | E05B 73/0041 70/57.1 |
| 2006/0070410 | A1 * | 4/2006 | Fuss | E05B 73/0017 70/57.1 |
| 2006/0272371 | A1 * | 12/2006 | Lycoudis | B60R 25/005 70/202 |
| 2012/0050042 | A1 * | 3/2012 | Shute | G08B 13/1445 340/572.1 |
| 2015/0009033 | A1 * | 1/2015 | Sandoval | G08B 13/1436 340/568.6 |

* cited by examiner

GOLF CLUB SECURITY DEVICE

CROSS-REFERENCE TO RELATED APPLICATION

This application is a non-provisional of, and claims the benefit and priority of, U.S. Provisional Patent Application No. 62/562,697, filed on Sep. 25, 2017. The entire contents of such application are hereby incorporated by reference.

BACKGROUND OF THE INVENTION

Shoplifting is a cost of doing business for retailers and securing inventory while displaying it for consumers is a real challenge. In many retail settings, expensive inventory or merchandise is housed in locked cabinets, secure back rooms, or is even kept behind the checkout counter. These methods require the assistance of a store employee to release the merchandise to the customer for inspection. While these methods of securing inventory work reasonably well for items that are not frequently purchased by consumers, or by retail settings that service small numbers of clients at a time, they are too restrictive for inventory that is frequently bought by consumers or for high traffic retail settings.

Multi-part golf clubs, such as clubs with removable heads, such as irons, woods, and putters, are becoming increasingly popular and increasingly expensive. These type of golf clubs allow the golfer to change club heads due to damage, obsolescence, or in a simple attempt to improve their game. In addition, removable club heads also increase the ease at which new club shafts can be installed on the club heads. In the retail setting, golfers are accustomed to handling golf clubs to test their balance, weight, and overall visual and physical feel. Current security devices allow golf clubs to be tethered to a display or may comprise an alarm triggered by an RFID, magnetic, or other such tag. While these classic methods of securing golf clubs may work well for the standard golf club, detachable head golf clubs pose a new challenge as the detachable heads themselves are becoming targets for theft. Accordingly, there is a need for an improved, easy-to-use golf club security device to prevent theft of detachable golf club heads while allowing the golfer to physically handle and examiner the golf club in a retail setting.

SUMMARY OF THE INVENTION

A system for security of a golf club is described herein. The system includes a body having a hinged interface section and a lock section. An arm is movably received in the lock section and the position of the arm relative to the body can be locked. The interface section can be locked about the shaft of a golf club and the arm can engage a head of the golf club. When the position of the engaged arm is locked relative to the body locked on the shaft, the security device prevents removal of the head from the shaft of the golf club.

In another embodiment, a system for security of a golf club is described. The system includes a body having a hinged interface section and a lock section. The interface section can be locked about the shaft of a golf club and includes an anti-theft device, such as a tag or alarm.

In another embodiment, a security device comprises a body comprising, a lock portion having a first surface and a second surface and a securing member. The lock portion may comprise a first opening configured to at least partially house a first engagement member, a second opening configured to at least partially house a second engagement member, and a bore extending between the first surface and the second surface. The securing member comprises a first interface portion having a locking member, a second interface portion, and a hinge member configured to pivotally couple the first interface portion to the second interface portion. The security device further comprises an extension having a first end and a second end and comprising a head engagement section proximate the first end, and a locking member engagement portion proximate the second end. In an assembled state, the extension is configured to be at least partially retained within the bore and the locking member engagement portion is configured to engage the first engagement member, and the second engagement member is configured to engage the locking member.

In another embodiment, a system for securing a golf club head comprises a body comprising a lock portion having a first engagement member, a second engagement member, and a bore extending through the body. A securing member comprises a first interface portion having a locking member and a second interface portion, wherein the first interface portion and second interface portion are pivotally coupled together by a hinge member configured to pivotally couple the first interface portion to the second interface portion. An extension having a head engagement section proximate a first end and a locking member engagement section proximate a second end is configured to couple to the couple to the securing member. In a secured state, the extension is configured to be at least partially retained within the bore and the lock member engagement portion is configured to engage the first engagement member to lock the securing member around a golf club shaft. The second engagement member is configured to engage the locking member to secure the head engagement section against the golf club head.

BRIEF DESCRIPTION OF THE DRAWINGS

A more particular description of the invention briefly summarized above may be had by reference to the embodiments, some of which are illustrated in the accompanying drawings. It is to be noted, however, that the appended drawings illustrate only typical embodiments of this invention and are therefore not to be considered limiting of its scope, for the invention may admit to other equally effective embodiments. Thus, for further understanding of the nature and objects of the invention, references can be made to the following detailed description, read in connection with the drawings in which.

The attached drawings are for purposes of illustration and are not necessarily to scale.

DETAILED DESCRIPTION OF THE INVENTION

Various golf club designs, including golf clubs with removable or interchangeable heads, are becoming increasingly popular with consumers. As the cost of these clubs increases, such golf clubs are also increasingly becoming targets for theft in stores or sales settings by removing the heads in the store. By incorporating security measures to lock the head to the shaft of the club, as described in the following description, a user can provide theft protection to a golf club in a sales setting.

Figure 1:
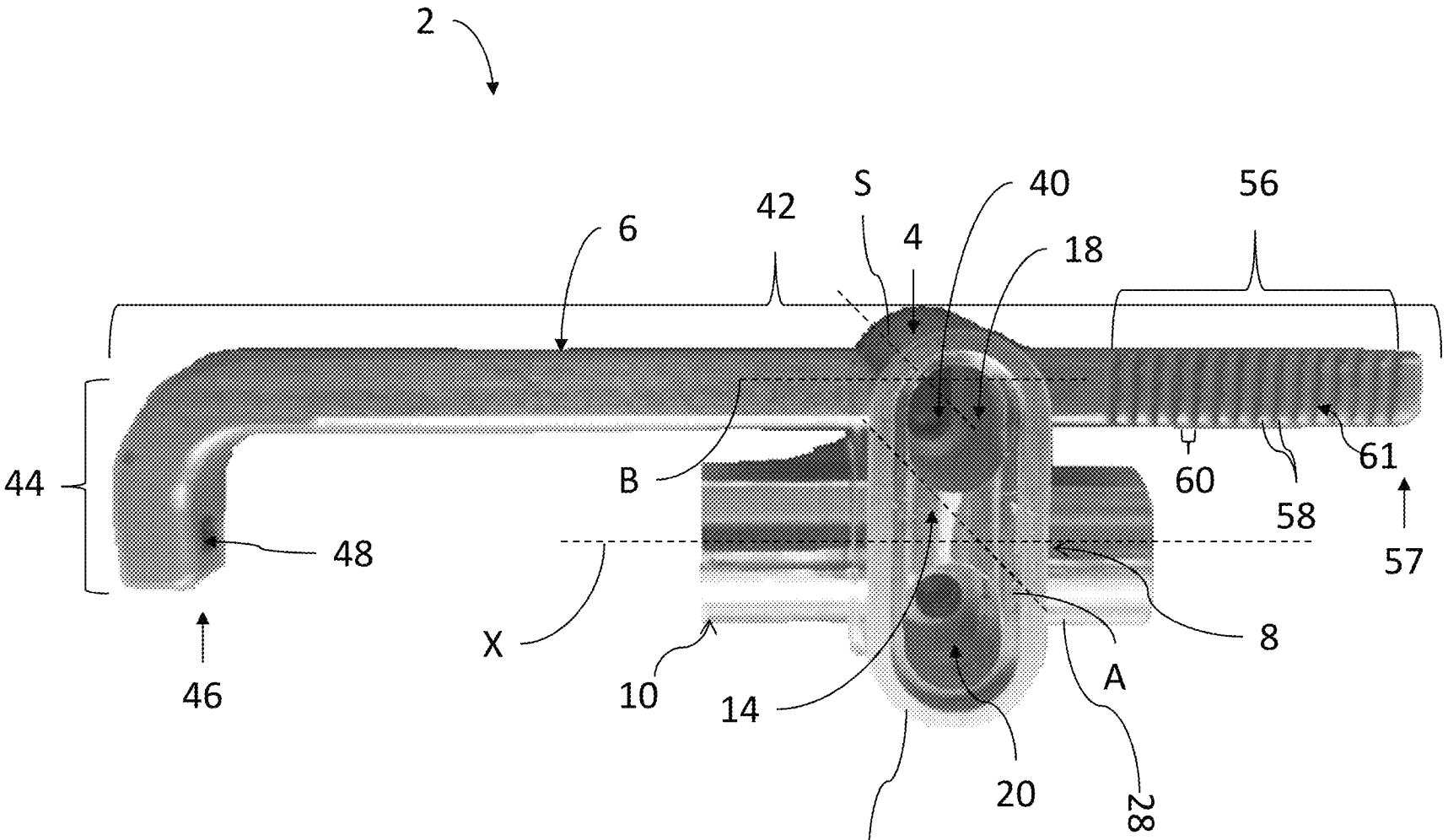
FIG. 1 is an illustration of an embodiment of a security device for a golf club.

FIG. 1 is a side view of an example of a security device or system 2 for a golf club 70 (FIGS. 9-12). The security device 2 comprises a body 4 and an arm 6 or extension. The security device 2 can be formed of any suitable material, such as, for example, a metal or plastic. In an embodiment, the security device 2 can be formed of iron or aluminum. In one embodiment, the body 4 and arm 6 are formed of the same material. In another embodiment, the body 4 is formed of a first material and the arm 6 is formed of a second material, different from the first material.

Figure 3:
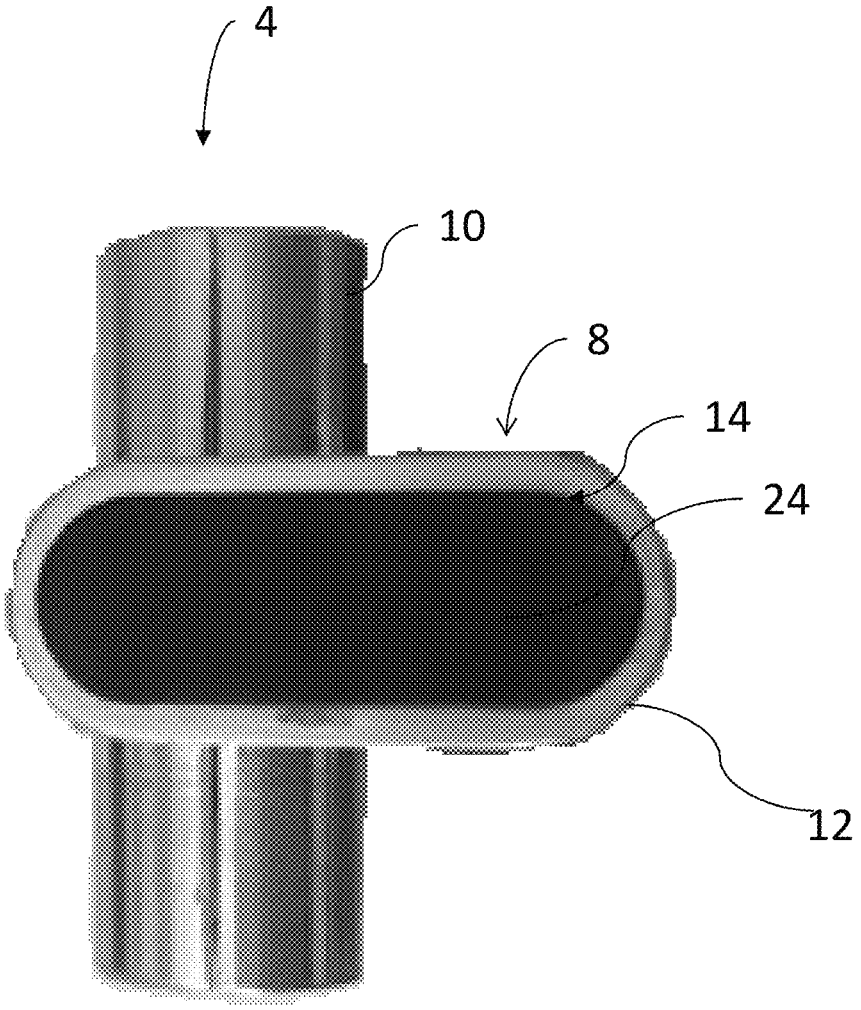
FIG. 3 is an illustration of the body of FIG. 2 further comprising a locking device.
Figure 4:
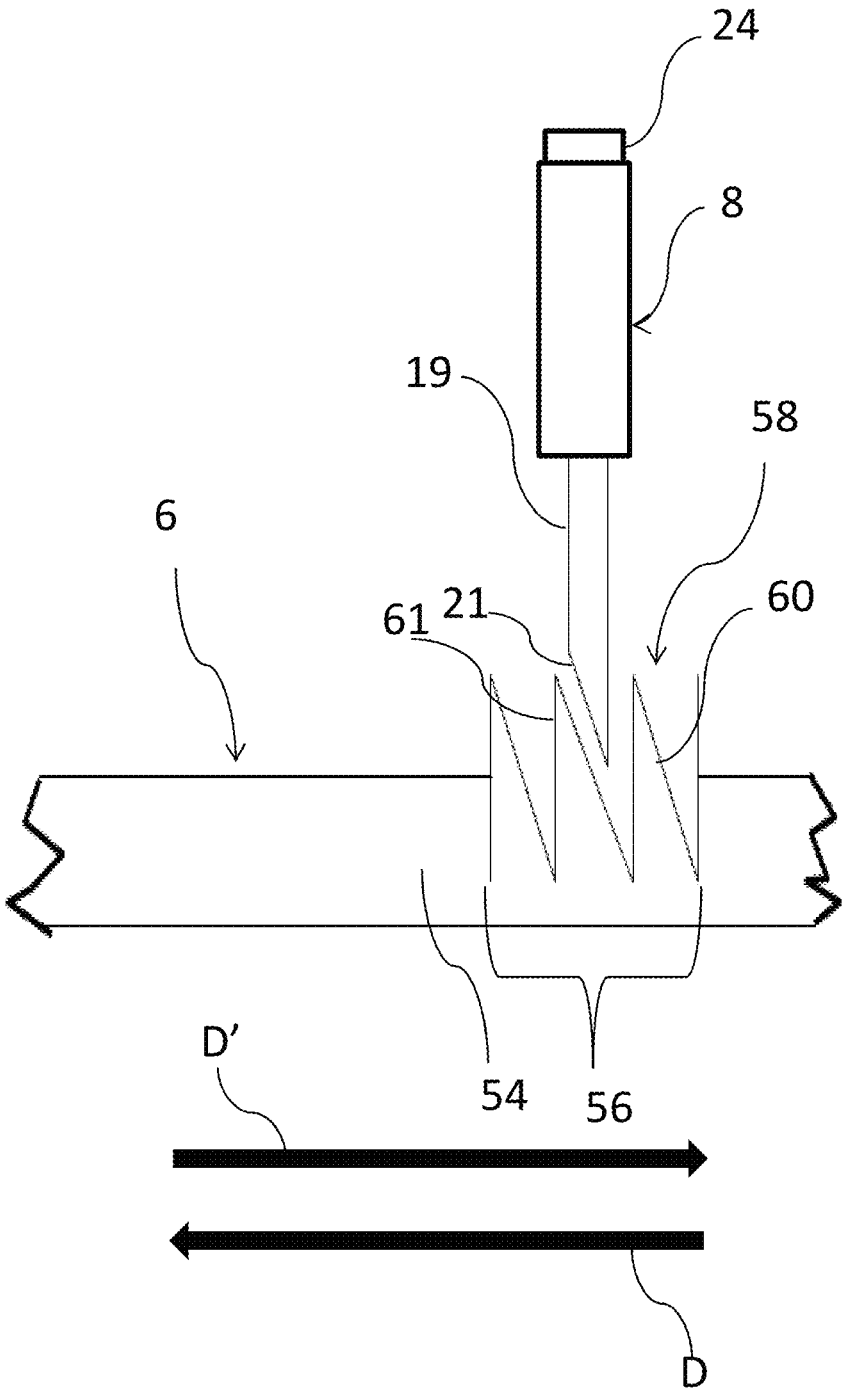
FIG. 4 is an illustration of an embodiment of a first engagement member interacting with a portion of an embodiment of an extension.
Figure 5:
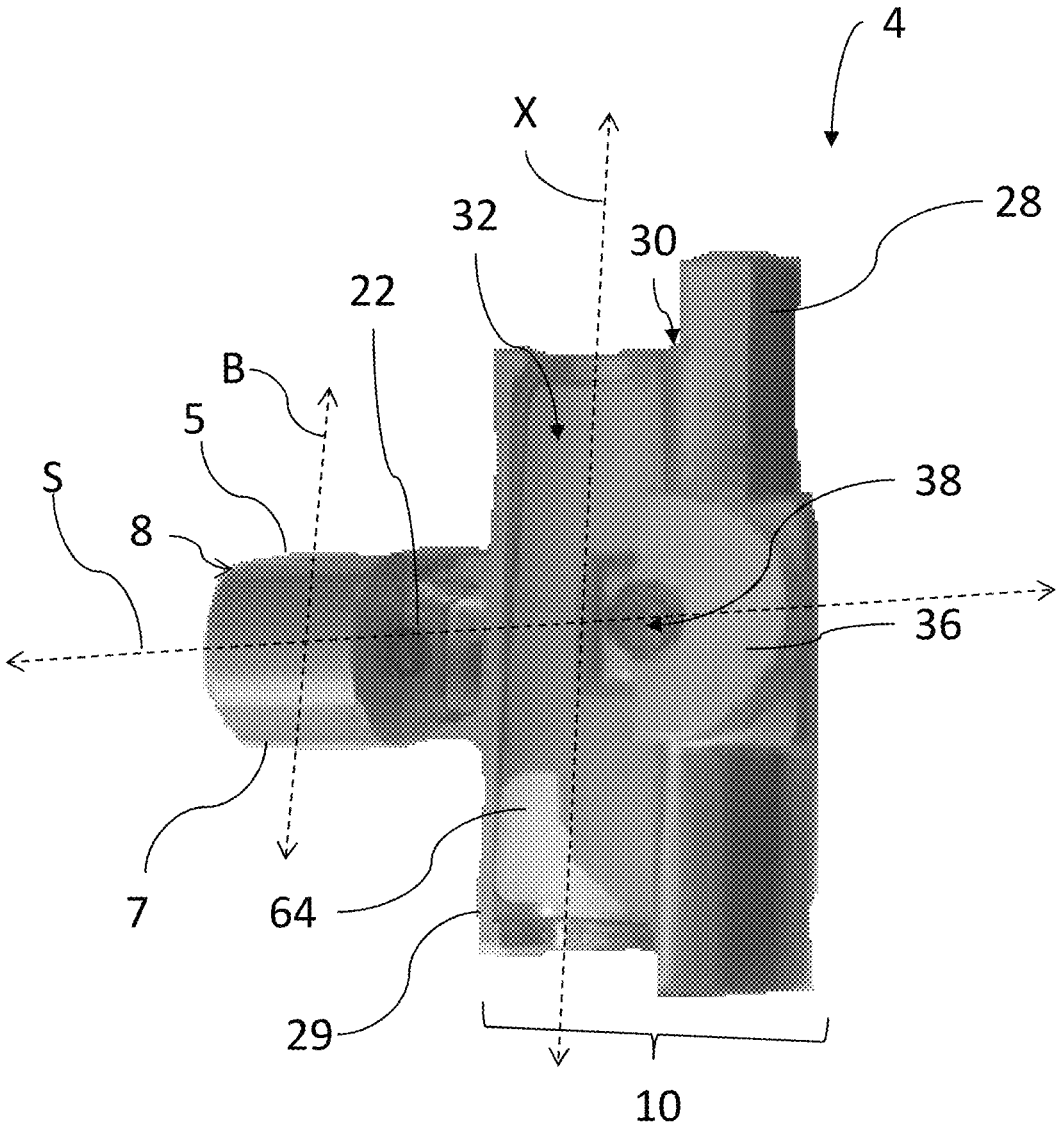
FIG. 5 is an illustration of a top view of an embodiment of the body in an open position.

As illustrated by FIGS. 2-7, the body 4 includes a lock section or lock portion 8 and a securing member or interface section 10 for interacting with the shaft of a golf club 70 (FIGS. 9-12). As shown, the interface section 10 comprises a first interface member 28 and a second interface member 29 that are pivotally coupled together by a hinge member 30. The hinge member 30 is configured to allow first interface member 28 and the second interface member 29 to pivot about the axis of rotation of the hinge member 30. Referring to FIGS. 1 and 5, the first interface member 28 and the second interface member 29 are configured to come together in a closed, locked, or secured position to define a hollow cylindrical shape extending along an axis X and having an opening space 32. As shown in FIG. 5, the hinge member 30 is configured to facilitate opening of the interface section 10 along the axis X to expose the opening space 32. In an embodiment, the opening space 32 is sized to accommodate at least a portion of a shaft of a golf club 72 (FIGS. 9-12).

Still referring to FIG. 5, the first interface member 28 includes a lock interface 36 opposite the hinge member 30. The lock interface 36 comprises a cavity 38 extending into the lock interface 36 along an axis S that intersects the axis X. In the illustrated embodiment, the lock section 8 is coupled to the interface section 10 and may be formed as a single integrated component with the second interface member 29.

Referring specifically to FIGS. 1-3, 9, and 11, the lock section 8 may be an oval-shaped block or body 12 with a recess 14 in the top surface 16 of the body 12. While the lock section 8 is illustrated as having an oval cross-sectional shape, it is to be understood that the lock section 8 can have any suitable cross-sectional shape, such as a rectangular or circular cross-sectional shape, among others.

Figure 2:
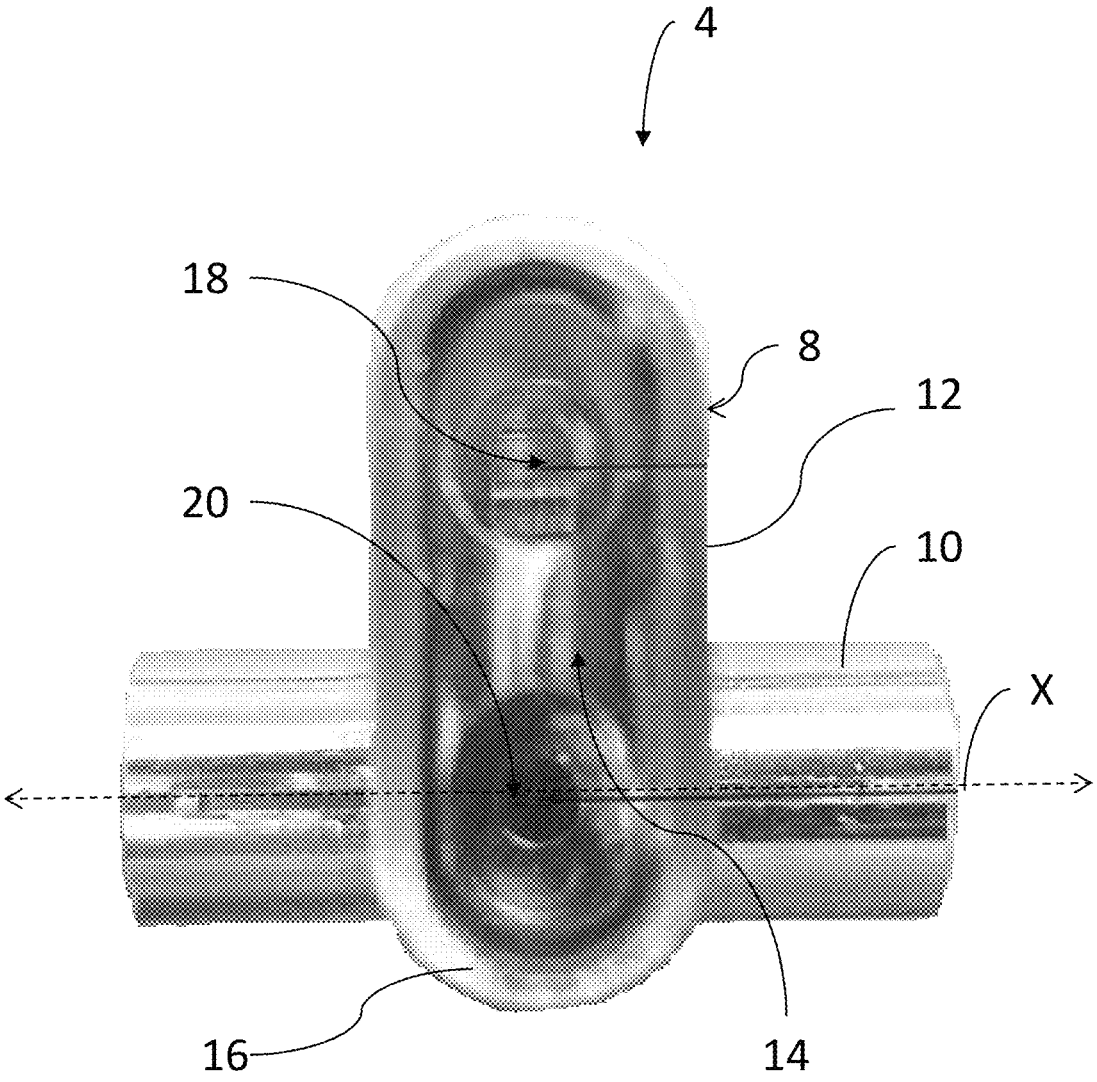
FIG. 2 is an illustration of an embodiment of a body of the security device of FIG. 1, without a lock device installed.

In the embodiment illustrated in FIGS. 2-3, a first opening or bore 18 extends from the recess 14 through the body 12 along an axis A (FIG. 5) and a second bore or opening 20, next or adjacent to the first opening 18, extends from the recess 14 through the body 12 along the axis A. In one embodiment, one or both of the first opening 18 and second opening 20 can have a varying cross-sectional shape, varying diameter, or both varying cross-sectional shape and varying diameter. In another embodiment, the diameter and or cross-sectional shape of at least one of the first opening 18 and the second opening 20 are unchanging or static along the length of each opening 18, 20. A first engagement member 19 (FIG. 4), such as a peg or rod, is retained within the first opening 18 and a second engagement member 22 (FIG. 5), such as a peg or rod, is retained within, and extending at least partially from, the second opening 20 opposite the recess 14.

As illustrated in FIGS. 3-4, a lock device or control device 24 is retained in the recess 14. The lock device 24 is configured to interact or interface with the first engagement member 19 and the second engagement member 22 to lock and unlock the components of the body 4. In the illustrated embodiment, the lock device 24 is a magnet retained in the recess 14 proximate the first and second engagement members 19, 22. In operation, when the first interface member 28 and the second interface member 29 of the interface section 10 are in the closed position, the engagement member 22 extends from the second opening 20 into the cavity 38 of the lock interface 36 to lock the first and second interface members 28, 29 in place. When a key device 26 (FIG. 7) engages the lock device 24, the lock device 24 engages or interfaces with the second engagement member 22 to draw the second engagement member 22 out of the cavity 38, thereby permitting the interface section 10 to unlock. Unlocking the interface section 10 allows the first and second interface members 28, 29 to be opened or pivoted in relation to each other about the hinge member 30. In an another embodiment, the engagement member 22 may be biased, such as by a biasing member (not shown) into a position in which a portion of the engagement member 22 extends out of the second opening 20. In this embodiment, the key device 26 and the lock device 24 together exert a force that overcomes the biasing force, causing the engagement member 22 to withdraw into the opening 20. In the illustrated embodiment, the lock device 24 and key device 26 are magnetic devices and the engagement member 22 is formed of a material, such as an iron material, subject to magnetic forces. In other embodiments, the lock device 24 and the key device 26 may not interact with each other via a magnetic force and may instead interact with each other mechanically or electronically such as, for example, with a mechanical key interface or via radio, biometric, or other form of electronic control.

Figure 6:
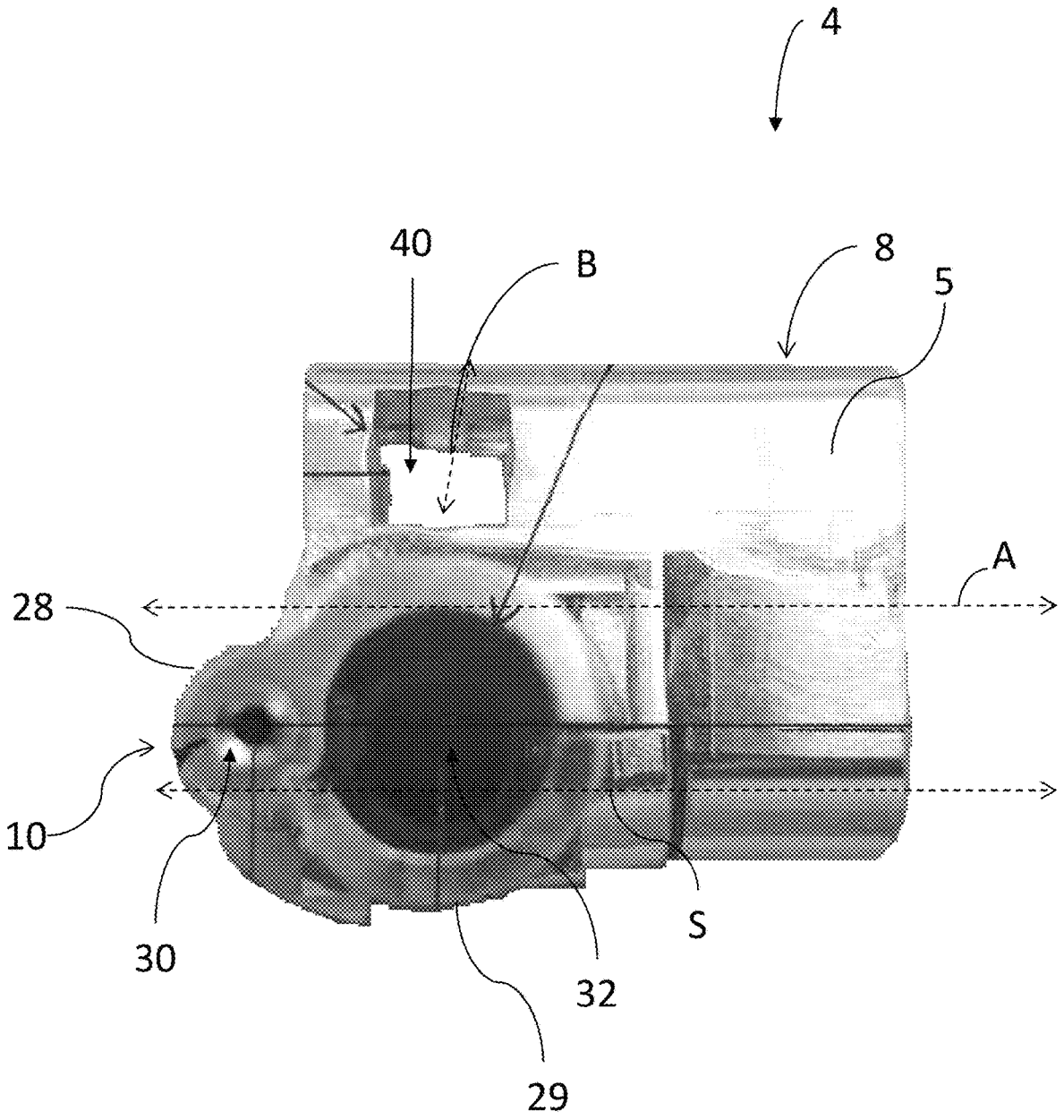
FIG. 6 is an illustration of a front view of an embodiment of the body in a closed position.

As illustrated by FIG. 6, the lock section 8 includes a bore 40 extending between a first side 5 (FIG. 1) and a second side 7 (FIG. 1) of the lock section 8 along an axis B (FIGS. 5-6) that intersects the axis A. In this embodiment the bore 40 extends entirely through the lock section 8 and intersects the first opening 18. In this embodiment, the first engagement member 19 (FIG. 4) extends at least partially into the bore 40.

Figure 7:
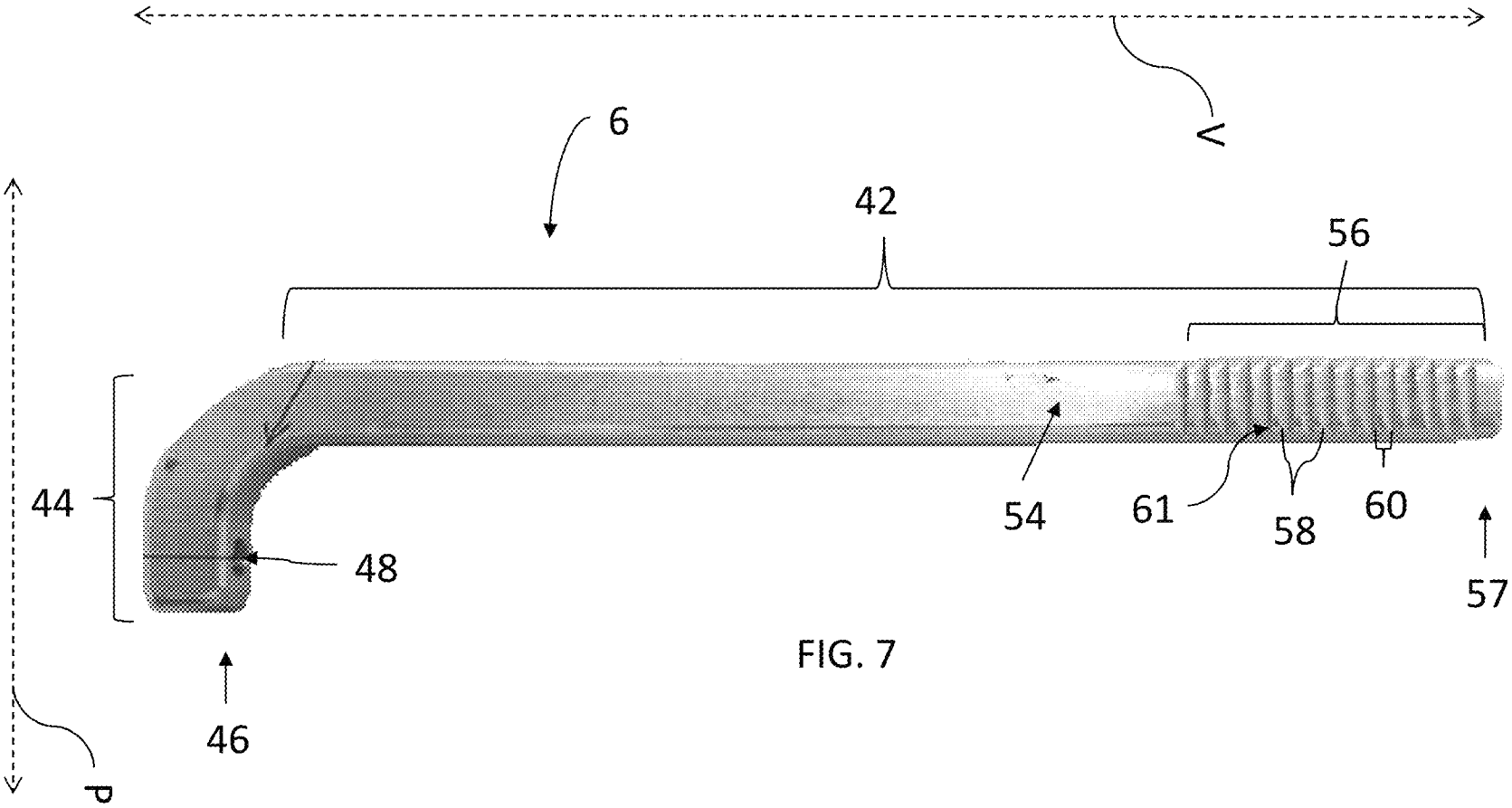
FIG. 7 is an illustration of an embodiment of the extension of the security device of FIG. 1.
Figure 8:
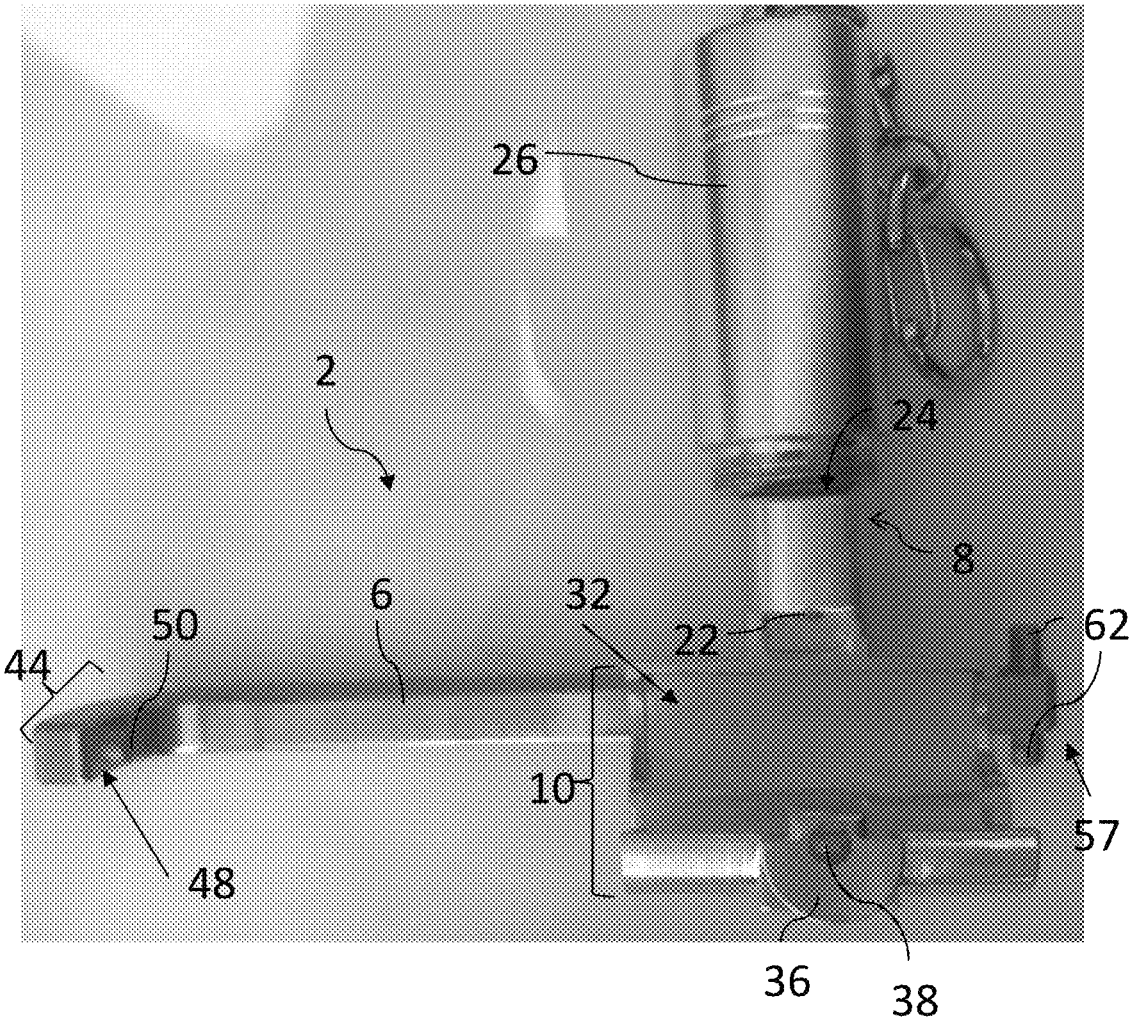
FIG. 8 is an illustration of a top view of an embodiment of the security device with the body in an open position with an embodiment of a locking section in contact with a key device.
Figure 9:
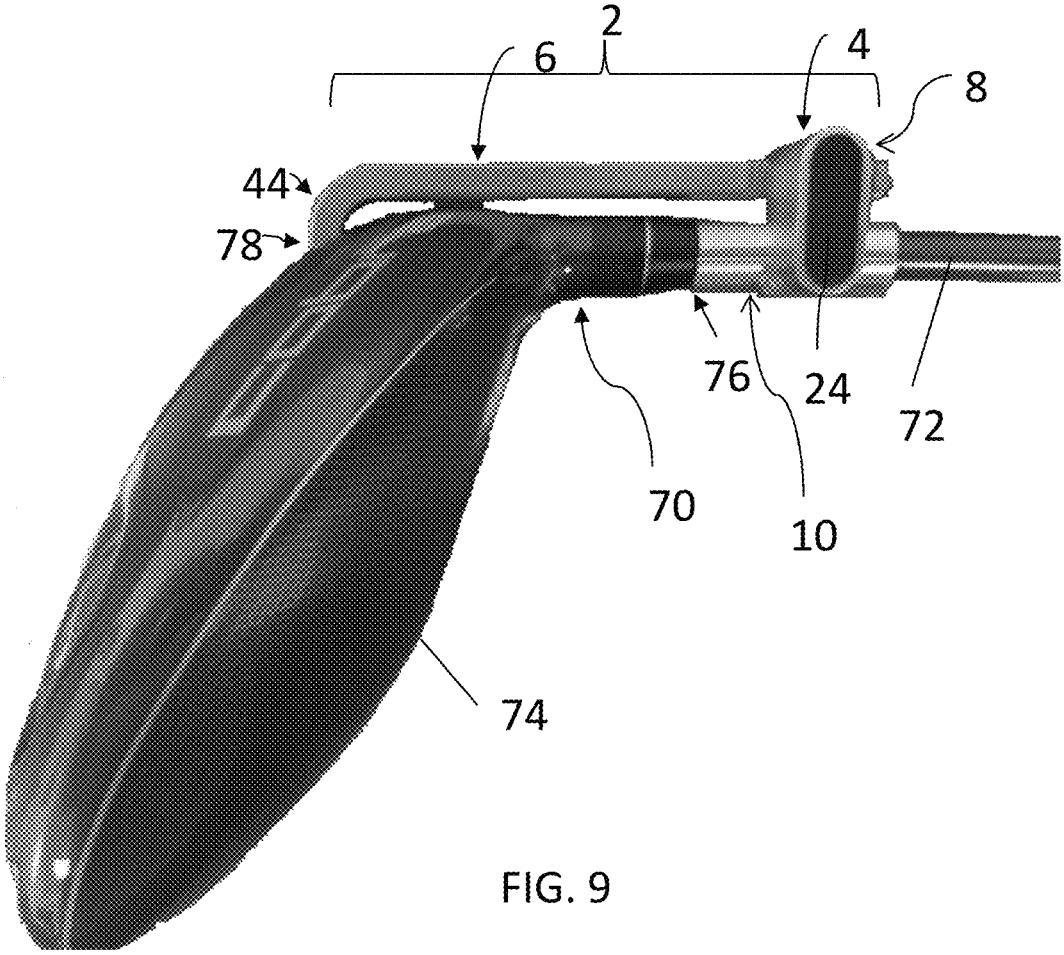
FIG. 9 is an illustration of a side view of an embodiment of the security device mounted on an embodiment of a golf club.
Figure 10:
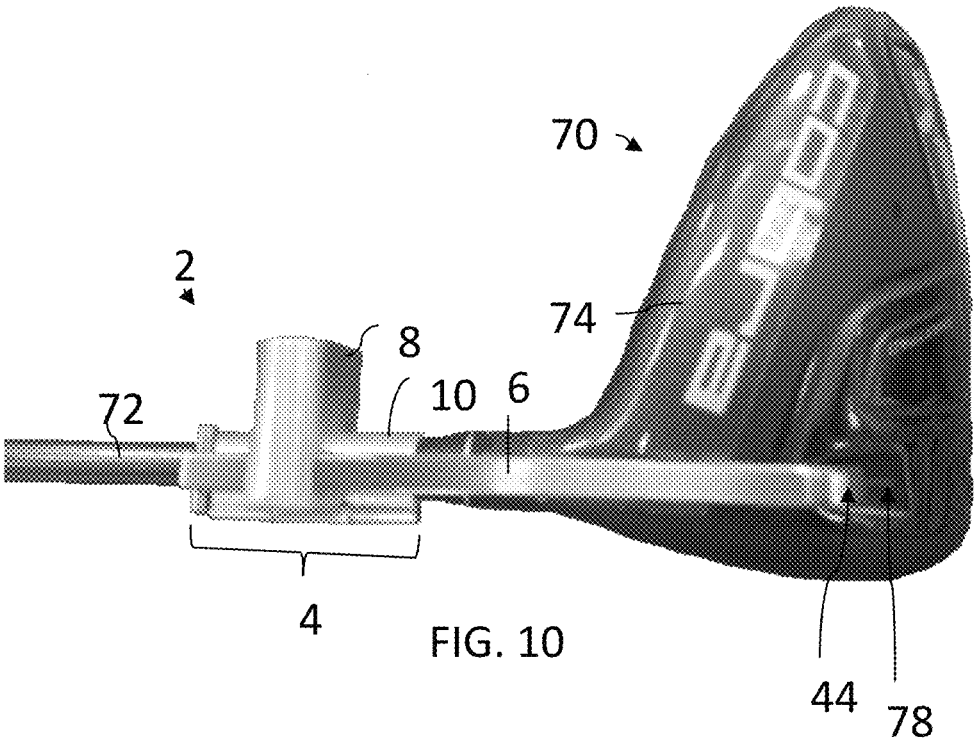
FIG. 10 is another illustration of a bottom view of an embodiment of the security device mounted on an embodiment of a golf club.
Figure 11:
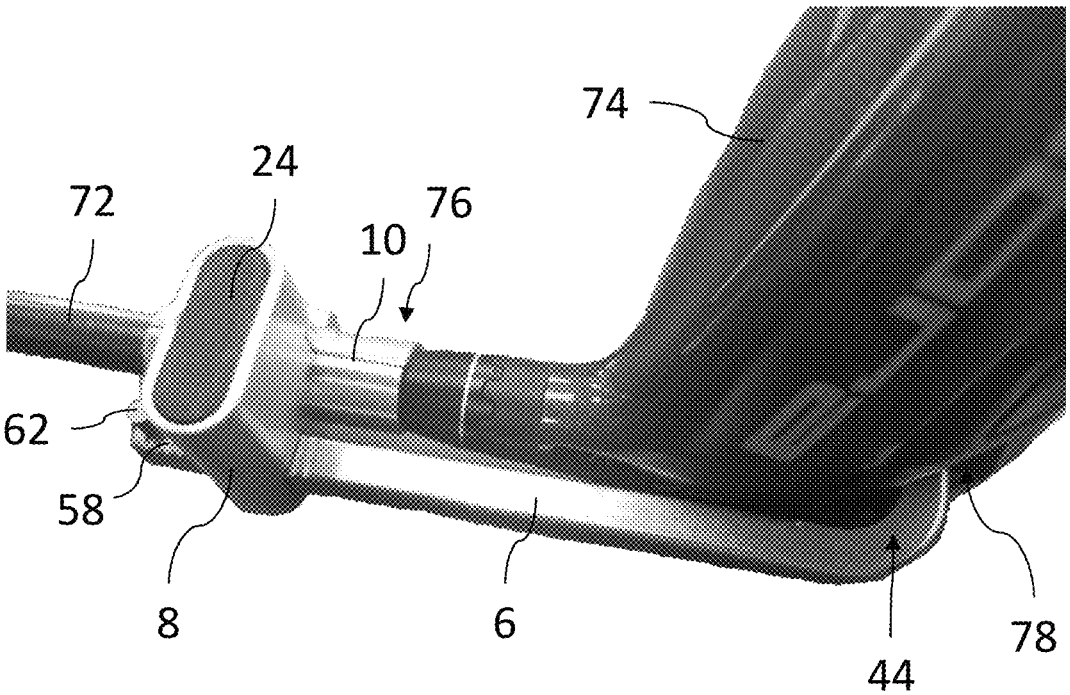
FIG. 11 is an illustration of a back view of an embodiment of the security device mounted on an embodiment of a golf club.
Figure 12:
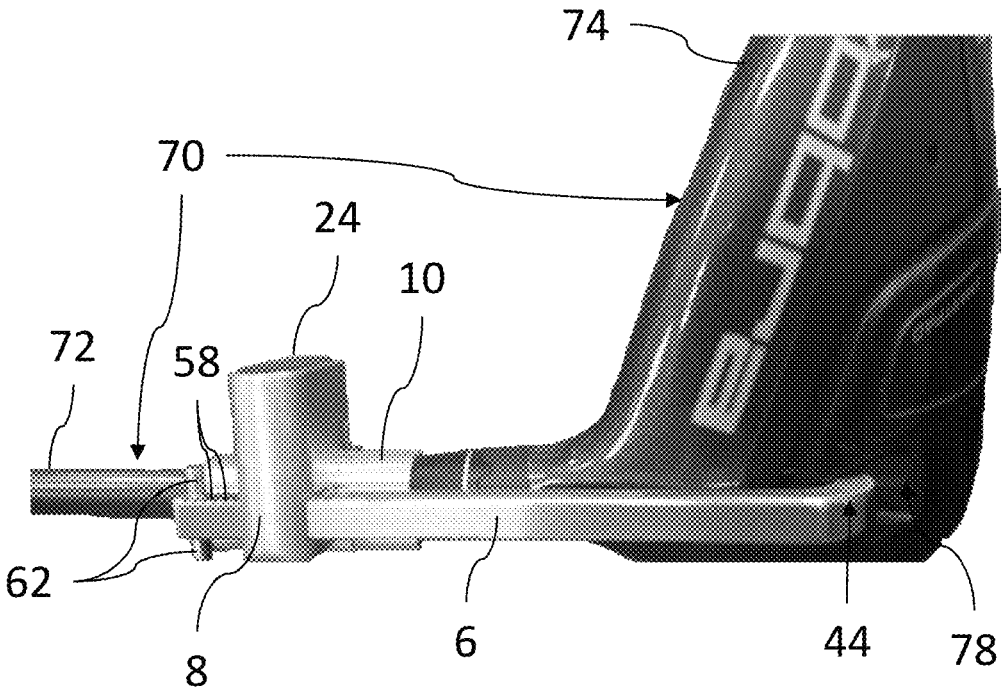
FIG. 12 is another illustration of a side view of an embodiment of the security device mounted on an embodiment of a golf club.

Referring particularly to FIG. 7, the arm 6 of the security device 2 has a linear section 42 extending along an axis V (longitudinal axis) and having a first end 46 comprising a head engagement section 44, and a second end 57. In the illustrated embodiment, the head engagement section 44 extends along an axis P that intersects the axis V, giving the arm 6 an L-shape. The head engagement section 44 includes a head engagement surface 48 that is configured to engage a surface of the head of a golf club 74 (FIGS. 9-12). In one embodiment, as illustrated in FIG. 6, the head engagement surface 48 is a linear surface. In another embodiment, an extension 50 (FIG. 8) extends or protrudes from the head engagement surface 48 to securely engage the golf club head 74 (FIGS. 9-12). In another embodiment, the head engagement surface 48 may include one or more surface features or detents configured to engage the head of the golf club (FIGS. 9-12).

As illustrated by FIG. 6, at the second end 57 of the arm 6, opposite the first end 46, at least one surface 54 of the arm 6, extending along the axis V, includes a friction surface 56. In the illustrated embodiment, the friction surface 56 includes a plurality of ridges or detents 58 extending outward from the surface 54. In one embodiment, the plurality of ridges 58 each includes a sloped surface 60 angling away from the first end of the arm 6 and an upright surface 61 at one end of the sloped surface 60. As shown, the sloped surface 60 is positioned at an angle that is less than 90.degree. relative to the axis V. In one embodiment, illustrated in FIG. 8, one or more stop members 62 can be positioned at the second end 57.

The linear section 42 of the arm 6 is configured to be movably or slideably retained within the bore 40 extending through the lock section 8, as illustrated in FIGS. 1 and 7. The first engagement member 19 (FIG. 4) within the first opening 18 extends at least partially beyond the first opening 18 and interfaces with the friction surface 56 to lock the position of the arm 6 relative to the lock section 8. Referring to FIG. 4, the arm 6 can freely slide within the bore 40 in a first direction D to permit the head engagement section 44 to freely tighten or approach the lock section 8. In the opposite direction, the interaction of the engagement surface 21 and the friction surface 56 prevents movement of the arm 6 relative to the body 4 in a second or opposite direction D', thereby locking the position of the head engagement section 44 relative to the lock section 8. For example, when the arm 6 slides in the first direction D, the first engagement member 19 slides along the sloped surfaces 60 of the friction surface 56, permitting the motion, but in the second direction D', the first engagement member 19 encounters the upright surfaces 61 of the friction surface 56, preventing movement in the second direction D'.

The lock device 24 is operable with the key device 26 to disengage the first engagement member 19 (FIG. 4) from the friction surface 56 to permit the arm 6 to loosen or the head engagement section 44 to move away from the lock section 8. For example, the first engagement member 19 can be biased, such as by a biasing member (not shown) into a position extending at least partially beyond the first opening 18. The lock device 24 and key device 26 can together exert a force, such as via a magnetic field, that overcomes the biasing force, causing the first engagement member 19 to withdraw into the first opening 18. By moving or sliding the arm 6 within the bore 40, the position of the head engagement section 44 relative to the lock section 8 can be adjusted. While the lock device 24 and key device 26 have been described here as being magnetic materials, it is to be understood that alternative locking mechanisms can be employed. For example, a manual or digital locking system, such as with a tumbler, could be used, among other mechanisms.

In an embodiment, the arm 6 can include at least one stop member 62 extending from a surface 54 of the linear section 42 at the second end 57 of the arm 6 to prevent the arm 6 from being removed from the bore 40. Alternatively, the surfaces 54 of the second end 57 of the arm 6 can be smooth in order to permit the arm 6 to be entirely removed from the bore 40.

In an embodiment, the security device 2 can include an identification tag 64, such as a radio frequency identification (RFID) tag 64. In an example, the tag 64 can be positioned within the opening space 32 of the interface section 10 to prevent unauthorized removal of the tag 64. In an embodiment, the tag 64 can be configured to initiate an alarm, such as a visual, audible, or visual and audible alarm when the tag 64 is transported beyond a predetermined perimeter. In another embodiment, the security device 2 can include an alarm system, such as an alarm device configured to emit an audible, visual, or audible and visual alarm, a speaker, and a battery to power the alarm system. For example, the alarm system can include radio frequency technology. The body 4 can be sized and shaped to accommodate the components of the alarm system.

In an alternative embodiment, a security device includes the body 4 having the lock section 8 and interface section 10. A security device, such as the tag 64 or alarm system, is coupled to the body 4. The interface section 10 is configured to lock about the shaft of a golf club. However, in this embodiment, the security device does not include an arm. In an embodiment, the security device can be used with golf clubs having non-removable heads.

FIGS. 9-12 illustrate an embodiment of a security device, such as the security device 2 described above, positioned on a golf club 70. As illustrated, the golf club 70 includes a linear shaft golf club 72, such as a cylindrical shaft, and a club head 74 coupled to the golf club shaft 72. In an embodiment, the club head 74 is removably coupled to the golf club shaft 72, such as through a screw or press fit connection.

In order to secure the golf club 70 within the security device 2, the key device 26 (FIG. 8) engages the lock device 24, causing the second engagement member 22 to retract and permit the interface section 10 to open via the hinge member 30. The interface section 10 can be placed around the golf club shaft 72 of the golf club 70 and closed so that the engagement member 22 is received in the cavity 38, locking the interface section 10 in position around the perimeter of the golf club shaft 72. The head engagement surface 48 is positioned to engage or be received by an engagement surface 78 of the club head 74. The engagement surface 78 can be a linear surface, a cavity, opening, or other surface configured to engage and retain the head engagement surface 48. The position of the head engagement surface 48 can be adjusted by sliding the body 4 relative to the arm 6, or vice versa, until one end 76 of the interface section 10 of the body 4 abuts the club head 74 and the first engagement member 19 (FIG. 4) engages the friction surface 56. The body 4 and arm 6 interact to inhibit removal of the club head 74 from the golf club shaft 72 when the security device 2 is securely positioned on the golf club 70. The security device 2 can be removed by disengaging the engagement members 19, 22 to open the interface section 10 and permit the arm 6 to move relative to the body 4. In an embodiment, the arm 6 can be tightened on the golf club 70 without the key device 26, but cannot be loosened or removed from the golf club 70 without the key device 26.

One advantage that can be realized by the security device 2 is the simple application and removal of a device by sales personnel to prevent theft of golf club heads.

The invention is inclusive of combinations of the aspects described herein. References to "a particular aspect" and the like refer to features that are present in at least one aspect of the invention. Separate references to "an aspect" (or "embodiment") or "particular aspects" or the like do not necessarily refer to the same aspect or aspects; however, such aspects are not mutually exclusive, unless so indicated or as are readily apparent to one of skill in the art. The use of singular or plural in referring to "method" or "methods" and the like is not limiting. The word "or" is used in this disclosure in a non-exclusive sense, unless otherwise explicitly noted.

The invention has been described in detail with particular reference to certain preferred aspects thereof, but it will be understood that variations, combinations, and modifications can be effected by a person of ordinary skill in the art within the spirit and scope of the invention.

The invention claimed is:

1. A security device comprises:

a body comprising, a lock portion having a first surface and a second surface and comprising, a first opening configured to at least partially house a first engagement member, a second opening configured to at least partially house a second engagement member, and a bore extending between the first surface and the second surface, and a securing member comprising, a first interface portion having a locking member, a second interface portion, and a hinge member configured to pivotally couple the first interface portion to the second interface portion; and an extension having a first end and a second end and comprising, a head engagement section proximate the first end, and a locking member engagement portion proximate the second end, wherein in an assembled state, the extension is configured to be at least partially retained within the bore and the locking member engagement portion is configured to engage the first engagement member, and the second engagement member is configured to engage the locking member.

2. The security device of claim 1, wherein the lock portion further comprises a lock device configured to interact with the first engagement member and the second engagement member.

3. The security device of claim 1, where in the extension further comprises one or more stop members configured to prevent the extension from separating from the lock portion in an unlocked state.

4. The security device of claim 1, wherein the securing member further comprising a tag configured to initiate an alarm the tag is transported beyond a predetermined perimeter.

5. The security device of claim 2, wherein in a locked state, the lock member engagement portion is configured to engage the first engagement member to lock the securing member around a golf club shaft, and the second engagement member is configured to engage the locking member to secure the head engagement section against a golf club head.

6. The security device of claim 5, wherein a key device is configured to interact with the lock device to disengage the first and second engagement members.

7. The security device of claim 1, wherein the locking member engagement portion comprises a plurality of detents, wherein each of the plurality of detents comprises at least one surface that is sloped at an angle less than 90° relative to the extension.

8. A system for securing a golf club head, the system comprising:

a body comprising, a lock portion further comprising a first engagement member, a second engagement member, and a bore extending through the body, and a securing member comprising a first interface portion having a locking member and a second interface portion, wherein the first interface portion and second interface portion are pivotally coupled together by a hinge member configured to pivotally couple the first interface portion to the second interface portion; and an extension having a head engagement section proximate a first end and a locking member engagement section proximate a second end, wherein in a secured state, the extension is configured to be at least partially retained within the bore and the lock member engagement section is configured to engage the first engagement member to lock the securing member around a golf club shaft, and wherein the second engagement member is configured to engage the locking member to secure the head engagement section against the golf club head.

9. The system of claim 8, wherein the lock portion further comprises a lock device configured to interact with the first engagement member and the second engagement member.

10. The system of claim 9, wherein a key device is configured to interact with the lock device to disengage the first and second engagement members.

11. The system of claim 8, wherein the locking member engagement section comprises a plurality of detents, wherein each of the plurality of detents comprises at least one upright surface and at least one surface that is sloped at an angle less than 90° relative to a longitudinal axis.

12. The system of claim 8, wherein the extension further comprises one or more stop members configured to prevent the extension from separating from the lock portion in an unlocked state.

13. The system of claim 8, wherein the securing member further comprising a tag configured to initiate an alarm the tag is transported beyond a predetermined perimeter.

14. The system of claim 13, wherein the tag is an RFID tag.

* * * * *